US008466361B1

(12) United States Patent
Eaton

(10) Patent No.: US 8,466,361 B1
(45) Date of Patent: Jun. 18, 2013

(54) VENTURI DIDGERIDOO

(75) Inventor: Charles Adams Eaton, Corrales, NM (US)

(73) Assignee: Charles Eaton, Corrales, NM (US)

( * ) Notice: Subject to any disclaimer, the term of this patent is extended or adjusted under 35 U.S.C. 154(b) by 0 days.

(21) Appl. No.: 13/554,713

(22) Filed: Jul. 20, 2012

(51) Int. Cl.
*G10D 7/00* (2006.01)

(52) U.S. Cl.
USPC ..... 84/330; 84/380 C

(58) Field of Classification Search
USPC ..... 84/330
See application file for complete search history.

(56) References Cited

U.S. PATENT DOCUMENTS 6,664,454 B1 * 12/2003 Johnson ..... 84/383 R

* cited by examiner

*Primary Examiner* — Christopher Uhlir

(57) ABSTRACT

The "Venturi Didgeridoo" or "Reverse Didgeridoo" is a musical instrument played in the manner of a didgeridoo (i.e. with an "unvoiced linguolabial trill" made by loosely vibrating or "fluttering" lips). It consists of one or more venturi chambers in which the diameter of the mouth opening (proximal end) is greater than the diameter of the opening at the distal end (in novel contrast to the construction of any other end-blown musical instrument). This tapered tube constitutes a venturi chamber in which the velocity of air is increased at the point of greatest constriction and in which internal pressure is increased at the point of greatest diameter. This unique acoustical design creates pitches that are much lower than those possible in traditional didgeridoos of equal length. A sequence of several separate venturi chambers consisting of graduated cylinder sections of diminishing diameter will result in an extremely compact, collapsing (telescoping) instrument.

2 Claims, 1 Drawing Sheet

VENTURI DIDGERIDOO

REFERENCES CITED

U.S. Patent Documents

| | | |
|---|---|---|
| 6664454 | Dec. 16, 2003 | Johnson |

(The compact "Didjbox" didgeridoo)

OTHER REFERENCES

Internet: www.didgeridoostore.com/didgeridoo_modern3.htm (A collapsible didgerido)

BACKGROUND OF THE INVENTION

1. Field

This invention pertains to musical instruments. It is directed to end-blown wind instruments played in the manner of the Didgeridoo (Yidaki) of Aboriginal players of Australia's Northeast Arnhem Land. It provides an end-blown instrument that emulates the sound of the Didgeridoo while being designed around one or more venturi chambers. Unlike other didgeridoos, it consists of a venturi chamber(s) tapered from the proximal to the distal end—or may be modified by creating two venturi chambers with cylinders of diminishing diameter toward the distal end. The mouthpiece is at the largest (proximal) end—i.e. the reverse of the yidaki or Didgeridoo design.

2. Background

The shapes of tubular end-blown wind instruments played by mouth are dominantly of three types: straight cylinders, tapered cones, and combinations of straight cylinders and cones—none of which decrease in diameter from the proximal end. Any of these types may also include a flair at the distal end. No end-blown wind instrument before this invention (the "Venturi-Didgeridoo") is constructed in such a way that the ratio of the diameter of the proximal end to that of the distal end creates a venturi effect.

The Australian Yidaki or Didgeridoo differs from all other end-blown instruments in that it does not have a small-diameter mouthpiece (e.g., trumpets, trombones, French Horns, etc.) The mouthpiece of a trombone narrows to a diameter of c. 9.3 mm. Even the tuba constrains air to an outlet of about 10.89 mm, whereas the didgeridoo has an opening that varies from about 28 mm to 40 mm or more. The result of this is that in playing the didgeridoo the lips do not vibrate with the high frequency of its distant cousins in the brass instrument family—but with loosely vibrating or "fluttering" lips, somewhat like the vibration rate of a Bronx Cheer or, technically, an "unvoiced linguolabial trill". This produces the low, haunting, idiosyncratic sound of the didgeridoo.

Traditional didgeridoos are made from the trunks (sometimes branches) of live Eucalyptus trees that have been hollowed out by termites. After tapping on various such trees, one is chosen by the artisan and cut down. The termites are driven out by the application of hot coals, after which the interior of the trunk is scraped and further hollowed out. The narrowest end is chosen as the point at which to form the mouthpiece. Sometimes the diameter is small enough (c. 28 mm-40 mm) to accommodate the loose, fluttering-lip technique used to play the instrument. However, the proximal diameter of a Eucalyptus didgeridoo is usually larger than 35 mm, so a beeswax mouthpiece may be shaped to reduce the diameter to a comfortable playing size. The preferred pitches of Aboriginal players are two octaves below Middle C and range in pitch from B-2 to E-2 (61.7 hz to 82.4 hz) with a decided preference for C#-2 (69.3 hz)

The wavelength of a sound produced in an open cylinder or pipe is very close to twice the length of the pipe itself. A 48" un-tapered cylinder will play a fundamental note of C#. Most Australian didgeridoos are 48" or longer in length. However, if a didgeridoo is not a pure cylinder but becomes a tube with flair toward the distal end, the fundamental pitch will rise. This rise in pitch is found in all such didgeridoos. However, because of the complex inner shape of an instrument bored out by termites beginning at the base of the trunk, it is impossible to predict the resultant pitch with any precision. An examination of 16 top-concert-grade didgeridoos with pitches of C# at an Australian website (didjshop.com) shows an average length of 53.09". A 53" didgeridoo made of Bloodroot Eucalyptus (one of the two or three best woods for didgeridoos) weighs about 8.5 lbs.

Because of the weight and length of traditional didgeridoos, alternative materials and designs have been sought to create didgeridoos that are lighter, shorter, more durable, and portable.

All prior attempts to make a portable didgeridoo have dealt with the problem of pitch being related to length either by cutting the instrument in pieces that can then be fitted together—or by creating a serpentine airway within a box (U.S. Pat. No. 6,664,454). In this case, the lowest pitch of the "Didjbox" remains directly related to the length of the air column—which perforce must equal that of a standard, straight cylinder. Coiling, twisting, or convoluting the air column of a wind instrument does not in itself change its pitch (e.g. French Horn vs Herald Trumpet). Changing the air column length, however, does. The original Didjbox (U.S. Pat. No. 6,664,454) has a length of 24", a 2" mouth, a 3" distal bell, and weighs 1.75 pounds. Its internal air column is slightly over 48" (to result in a pitch of C-2). While portable, it is still rather large. Subsequent Didjbox iterations have achieved reduced overall size and weight by considerably reducing the diameter of the air column. While the resulting designs are lighter and smaller, the reduced internal diameters inevitably have a dampening impact on the sound characteristics generated.

Another prior attempt to increase didgeridoo portability is the Didgeridoo Store's "Travel Didgeridoo": www.didgeridoostore.com/didgeridoo_modern3.htm. Its sections can be linked to create a 66" instrument with a 4.5" bell. For travel, two 18" sections can be nested within the largest section. The third section is placed in the travel bag next to the collapsed sections—making total dimensions of 18"×6.5". Portable, but still large.

BRIEF SUMMARY OF THE INVENTION

In dramatic contrast to all other didgeridoos and end-blown wind instruments, the Venturi-Didgeridoo, with its venturi chamber(s), actually lowers the instrument's fundamental pitch considerably below that of a uniform cylinder of a given length—therefore allowing a shorter instrument without raising the pitch. The degree of pitch change of this unexpected and counterintuitive result is directly related to the ratio of the diameters of the proximal and distal ends. Because the diameter of the proximal end is constrained by the preference of didgeridoo players for a mouthpiece of 25 mm to 40 mm, the venturi effect (and pitch) is primarily modified by reducing or increasing the diameter of the distal end.

The venturi effect takes place when liquids or gasses moving through a cylinder find a constriction or reduction in the diameter of the cylinder. At and beyond the point of constriction, liquids or gasses move at higher velocity (think garden hose) and the pressure in the large diameter chamber is increased in relation to that in the chamber of smaller diameter. This increase in the pressure within the larger chamber (i.e. at the proximal end or mouthpiece) makes the instrument easier to play. Didgeridoo players call this "good back pressure". The Venturi-Didgeridoo consists either of one long, elongated venturi chamber with gradual tapering—or of two or more chambers consisting of cylinders of decreasing diameters linked together.

In any didgeridoo, the ratio of its length to its average internal diameter has a marked effect on its acoustical properties. A particular didgeridoo of any internal design with a length of 48" (121.9 cm) may, perhaps, be improved by shortening or lengthening it—or the sound quality may possibly be degraded. As a rule of thumb, it is often best to begin with a length of 48" and then experiment with greater and lesser lengths.

A 48" Venturi-Didgeridoo with a proximal Inner Diameter of 39 mm and a distal ID of 25 mm (see FIG. 1) will have a resultant fundamental pitch of B-2. To achieve this very low B-2 pitch in a uniform cylinder, it would have to be 54" long; the average top-quality Eucalyptus didgeridoo with a pitch of B-2 is c. 70" (because of the rise in pitch due to distal flair). The longest traditional B-2 didgeridoos are about eight feet long, so the 48" Venturi-Didgeridoo is astonishing in its ability to sound a fundamental of B-2.

If you take the above 48" Venturi-Didgeridoo and decrease the distal diameter below 25 mm while maintaining the same proximal diameter (39 mm), the pitch will be lowered—but the sound quality will be somewhat degraded. If you increase only the distal diameter, the pitch will rise—but the ease of playing will be reduced because of the reduction of "back-pressure" on the player's lips. A 48" Venturi-Didgeridoo made of fiberglass & resin has a total weight of less than 9 ounces—which brings it into a class of greater portability.

UTILIZATIONS

The "Walkabout Didgerido"

The 48" Venturi-Didgeridoo, when made of fiberglass and resin, weighs only 9 ounces. If the rubber tip for a cane is inserted into the distal opening (FIG. 2) and a cap with a strap is put over the proximal opening (FIG. 3), it is converted into a walking stick—or "Walkabout Didgeridoo". If the base of the cap is drilled and tapped, a properly threaded bolt will convert the "Walkabout Didgeridoo" into a monopod for camera stabilization (FIG. 3).

Ultra-Compact Telescoping Didgeridoos:

1. The Continuous-Taper Telescoping Didgeridoo

If a 46" fiberglass/resin tube is tapered from 38 mm at the proximal end to 20 mm at the distal end and then cut into 13" sections with 4.5" removed after each of the first two sections, these three sections can be slipped inside each other to form a telescoping unit that can be instantly collapsed or extended. (See FIG. 4) The resultant pitch is a pleasant, low D-2. Simple and elegant, this rugged, portable Venturi-Didgeridoo has maximum collapsed dimensions of 13" by 1.75" and weighs less than 5.5 ounces.

2. The Two-Venturi Telescoping-Cylinder Didgeridoo

A more flexible (and complex) telescoping didgeridoo can be constructed of three straight (un-tapered) 13" cylinders of decreasing diameter. The distal ends of the largest and the middle sections terminate in 1" inwardly tapered cones. (See FIG. 5) The proximal ends of the middle and third sections terminate in outwardly flaring cones that mate with the tapered cone of the section above it when the sections are slipped inside each other (see FIG. 5), thus creating an instrument with two venturi chambers. There are two advantages to this design:

1) By creating two venturi chambers using straight cylinders instead of tapered tubes, the ratio of the proximal and distal inner diameters can be adjusted so that the distal diameter may be somewhat increased relative to the proximal diameter. After testing many ratios, a proximal ID of 32 mm and a distal ID of 20 mm are found to be a happy combination.
2) The final (distal) section may be shortened to achieve a series of higher notes that can be played on this instrument. Therefore, by a simple switch of the terminal section, this didgeridoo can play a pitch of C-2 (13"), D-2 (8"), or E-2 (4.5"). This makes playing this instrument more adaptable when joined by other instruments (e.g., guitars, etc.).

DETAILED DESCRIPTION OF THE INVENTION

The several iterations of the Venturi-Didgeridoo have in common that they achieve their lower pitch in relation to length by employing the principles of venturi chambers. It is in this respect that they differ from all other end-blown wind instruments—whose fundamental pitches cannot be lower than the fundamental pitch of an un-tapered end-blown cylinder.

Figure 1:
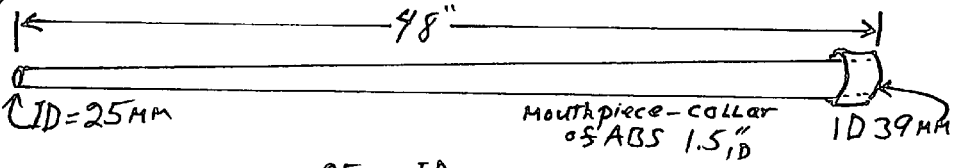
FIG. 1 Forty-eight inch Venturi-Didgeridoo with a proximal Inner Diameter of 39 mm and a distal ID of 25 mm FIG. 2 Rubber cane-tip for distal end of 48" "Walkabout Didgeridoo".
Figure 2:
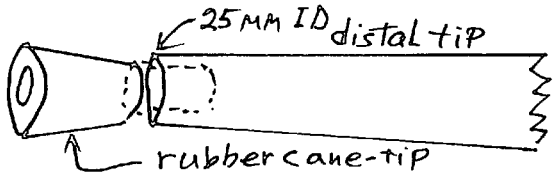
Figure 3:
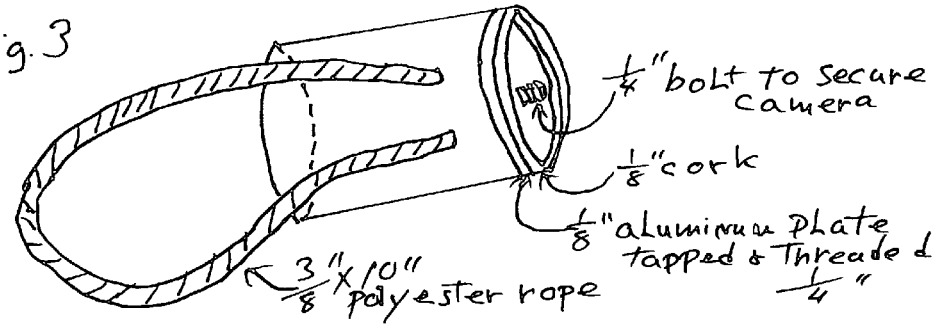
FIG. 3 Cap with strap and threaded bolt for proximal end of "Walkabout Didgeridoo".

The "Walkabout Didgeridoo" (FIG. 1) is 48 inches in length with a fundamental pitch of B-2. It is formed on a mandrel with a continuous taper that, over a 48" portion, declines from an Outer Diameter of 39 mm to an OD of 25 mm. The mandrel may be machined or otherwise constructed with tolerances close enough to allow the instrument to be removed from the mandrel without adhering to it. Releasing agents (waxes and/or sprays) are necessary in this process. While the instrument itself may be constructed from a variety of materials (carbon fiber, etc.), the use of fiberglass cloth with a weight of six to 8 ounces per square foot may be optimal. A piece of material slightly longer than the intended instrument should be cut to a width of at least 15". The reason for this is that less than 15" will reduce the structural strength of the instrument. Much greater than 15" will unnecessarily increase the wall thickness of the instrument. A thickness of about 1.5 mm is a good balance. A collar/mouthpiece at the proximal end may be formed from a short section of 1.5" ABS pipe—or of other materials (FIG. 1). When slipped from the distal to proximal ends, this collar will fit snugly—but may also be cemented in place. The length of this collar is subcritical. It may be as short as ¼" if it is only to be used as the mouthpiece, or as long as 3+" if it is also to function as the collar to support a cap. The instrument is now ready to play as it is. To complete the process of doubling as a walking stick, a rubber cane-tip may be inserted in the distal end (FIG. 2). The outer diameter of a ¾" rubber cane-tip will fit snugly into the distal, 25 mm ID end—but can also be easily removed for playing. The cap (FIG. 3) is formed of layers of fiberglass cloth (or other materials) around a 1.5" pipe. For strength and stability, its width should be about 2 mm and its length should equal the length of the ABS collar. The top of the cap consists of a round metal plate that is cemented in place on the inside with a mix of resin and fiberglass chop or other binding material. For the purpose of adequate strength consistent with light weight, ⅛' aluminum may be preferred over copper or other materials. To increase the versatility of this instrument, it may be adapted to be used as a camera monopod by drilling and tapping the center of the metal plate and then inserting a ½" bolt of ¼" stock. To cushion and protect the base of an attached camera, a ⅛$^{th}$ inch layer of cork may be cemented to the metal plate. When used as a walking stick, it is advantageous to have a hand-strap at the upper end (FIG. 3). A variety of methods may be used to achieve this, but a 10" length of ⅜$^{th}$ inch polyester or nylon rope is effective. ⅜$^{th}$ inch holes may be drilled in the cap just below the metal plate. Using a Forstner bit for the drilling will make a clean cut. The ⅜$^{th}$ inch rope may be tied off inside the cap.

Figure 4:
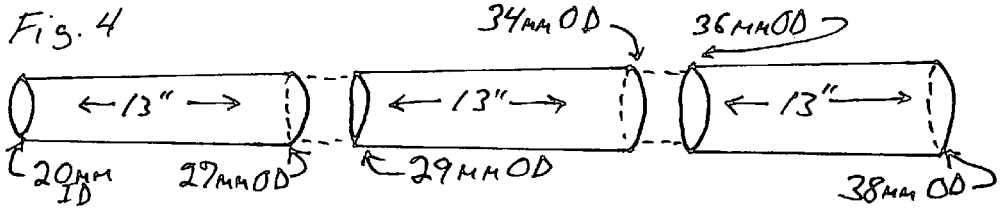
FIG. 4 Continuous-Taper Telescoping Didgeridoo showing sections removed to allow the instrument to be collapsed for compact portability.

The Continuous-Taper Telescoping Didgeridoo (FIG. 4) also constitutes a single venturi chamber. In the case of the "Walkabout Didgeridoo", the amount of taper from the proximal to the distal end of this instrument is kept to a minimum so that it can maintain the maximum distal diameter for reasons of sound quality, pitch, and length. Greater taper would result in pitches too low to be aesthetically pleasing at a length of 48". A telescoping venturi-didgeridoo has different requirements: it must achieve a fundamental pitch of between C-2 and E-2 while being short and light enough to exceed the portability of other prior designs. Furthermore, the rate of taper must be adequate to make a secure fit when the several units of the instrument are extended. If a mandrel is machined or constructed to have a taper of 38 mm to 20 mm over a 46" portion, a strong, light, compact, and very portable instrument can be produced. The materials of all of these iterations are the same (fiberglass cloth 15" wide, etc.) The resulting tapered tube may then be cut into 13" sections with 4.5" removed after each of the first two sections, these three sections can then be slipped inside each other to form a telescoping unit that can be instantly collapsed or extended.

Figure 5:
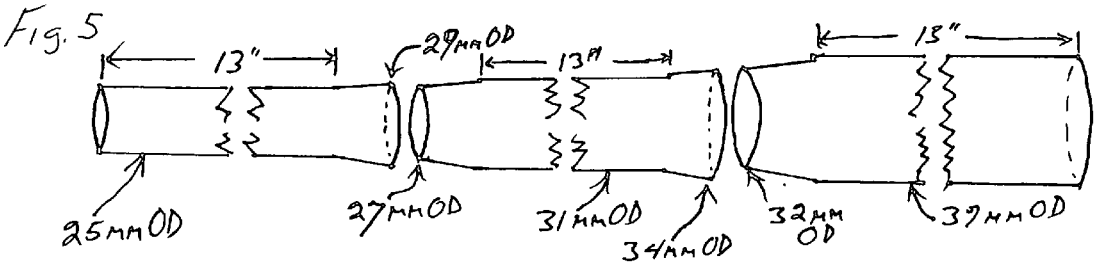
FIG. 5 Two-Venturi Telescoping-Cylinder Didgeridoo showing the construction of three 13" sections and the tapered cones that connect them.

The Two-Venturi Telescoping-Cylinder Didgeridoo (FIG. 5). A more flexible (and complex) telescoping didgeridoo can be constructed of three 13" or 14" straight, (un-tapered) cylinders of decreasing diameter. The reasons for using cylindrical sections instead of tapered sections are to increase the "brightness" of the tone and to allow the substitution of final sections of different lengths (to provide optional pitches for the instrument). The mandrel for the multiple-venturi instrument is considerably more complex and difficult to machine and construct. The distal ends of the largest and the middle sections terminate in a 1" inwardly tapered cone. (See FIG. 5) The proximal ends of the middle and third sections terminate in outwardly flaring cones that mate with the tapered cone of the section above it when the sections are slipped inside each other (see FIG. 5), thus creating an instrument with two venturi chambers. The mandrels for each of these sections must be slightly longer than the intended length of a given section so that a neat trim may then be made to its end/s. Tolerances for the mandrels must be kept low (particularly with any section with flares at each end) so that the fiberglass sections can be removed from the mandrel. Again, release agents are absolutely necessary. There are two advantages to this design:

1) By creating two venturi chambers using straight cylinders instead of tapered tubes, the ratio of the proximal and distal inner diameters can be adjusted so that the distal diameter may be somewhat increased relative to the proximal diameter. After testing many ratios, a proximal ID of 32 mm and a distal ID of 20 mm are found to be a happy combination.
2) The final (distal) section may be shortened to achieve a series of higher notes that can be played on this instrument. Therefore, by a simple switch of the terminal section, this didgeridoo can play a pitch of C-2 (13"), D-2 (8"), or E-2 (4.5"). This makes playing this instrument more adaptable when joined by other instruments (e.g., guitars, etc.).

The invention claimed is:

1. A musical instrument played by blowing air in a first end in the manner of an Australian Aboriginal Didgeridoo, the musical instrument comprising: a body comprising two or more un-tapered venture cylinder segments that can be nested or telescoped for portability; wherein each segment closer to a second end of the musical instrument, opposite the first end, has a diameter smaller than a diameter of any preceding segment closer to the first end.

2. The instrument of claim 1, further comprising: terminal sections of various lengths to provide different fundamental frequencies.

* * * * *

UNITED STATES PATENT AND TRADEMARK OFFICE

CERTIFICATE OF CORRECTION

PATENT NO. : 8,466,361 B1
APPLICATION NO. : 13/554713
DATED : June 18, 2013
INVENTOR(S) : Charles Adams Eaton It is certified that error appears in the above-identified patent and that said Letters Patent is hereby corrected as shown below:

In the Claims

Col. 6, line 3, Claim 1 should read:

1. A musical instrument played by blowing air in a first end in the manner of an Australian Aboriginal Didgeridoo, the musical instrument comprising: a body comprising two or more untapered venturi cylinder segments that can be nested or telescoped for portability; wherein each segment closer to a second end of the musical instrument, opposite the first end, has a diameter smaller than a diameter of any preceding segment closer to the first end.

Signed and Sealed this
Seventeenth Day of December, 2013

Margaret A. Focarino

Margaret A. Focarino
*Commissioner for Patents of the United States Patent and Trademark Office*